United States Patent [19]

Isner

[11] Patent Number: 4,810,180

[45] Date of Patent: Mar. 7, 1989

[54] APPARATUS FOR THE ELECTROSTATIC TREATMENT OF MONOFILAMENTS

[76] Inventor: Robert E. Isner, 222 Martling Ave., Tarrytown, N.Y. 10591

[21] Appl. No.: 878,827

[22] Filed: Jun. 26, 1986

Related U.S. Application Data

[60] Division of Ser. No. 580,881, Feb. 16, 1984, Pat. No. 4,608,212, which is a continuation-in-part of Ser. No. 709,601, Jul. 29, 1976, abandoned.

[51] Int. Cl.[4] ..... B29C 35/08

[52] U.S. Cl. ..... 425/174.8 E; 264/22; 264/24; 264/237

[58] Field of Search ..... 425/174.8 E, 174.8 R, 425/174.6; 264/237, 26, 10, 22, 24, 108

[56] References Cited

U.S. PATENT DOCUMENTS

| | | | |
|---|---|---|---|
| 2,108,361 | 2/1938 | Asakawa | 425/174.8 E |
| 2,336,745 | 12/1943 | Manning | 264/DIG. 75 |
| 2,636,216 | 4/1953 | Huebner | 264/22 |
| 2,886,877 | 5/1959 | Frickert et al. | 65/10.1 |
| 2,908,545 | 10/1959 | Teja | 264/24 |
| 3,224,497 | 12/1965 | Blomgren, Sr. et al. | 425/174.8 E |
| 4,316,716 | 2/1982 | Lin | 264/24 |
| 4,486,365 | 12/1984 | Kliemann et al. | 264/22 |

FOREIGN PATENT DOCUMENTS

| | | | |
|---|---|---|---|
| 544904 | 8/1957 | Canada | 264/22 |
| 44-4248 | 2/1969 | Japan | 425/464 |
| 51-41763 | 4/1976 | Japan | 264/22 |

OTHER PUBLICATIONS

"Instant Cooling by Electrostatics", Business Week, 2 pages, Aug. 12, 1972.

*Primary Examiner*—Jay H. Woo
*Assistant Examiner*—C. Scott Bushey

[57] ABSTRACT

Apparatus for effecting the electrostatically induced thermal modification and disruptive surface deformation of liquid monofilamentous materials in a gaseous environment.

5 Claims, 1 Drawing Sheet

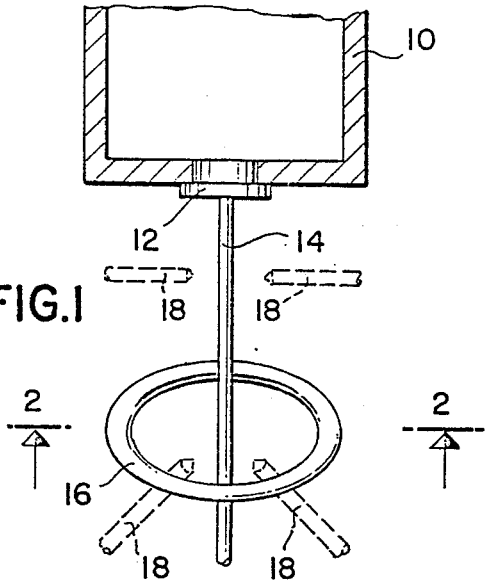
FIG.1
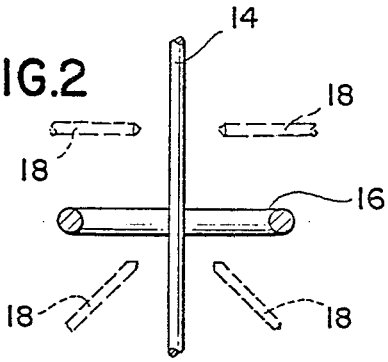
FIG.2
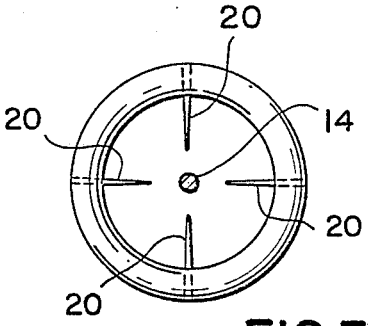
FIG.3
FIG.4
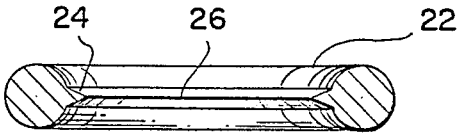
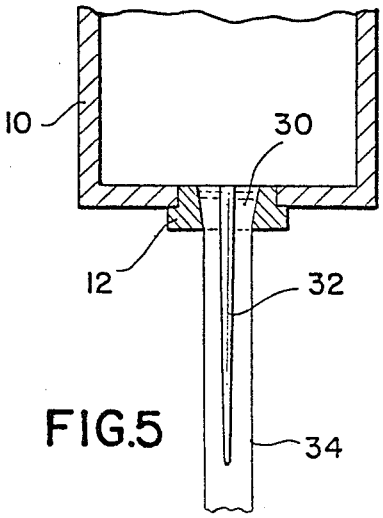
FIG.5
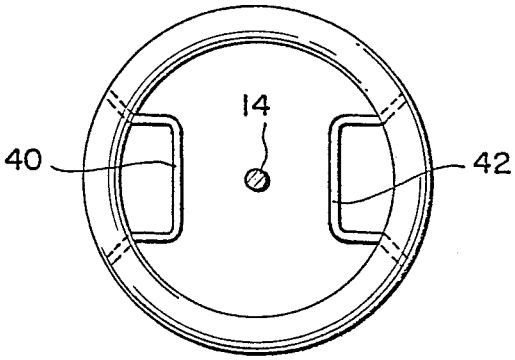
FIG.6

APPARATUS FOR THE ELECTROSTATIC TREATMENT OF MONOFILAMENTS

BACKGROUND OF THE INVENTION

This application is a division of my application Ser. No. 580,881 filed Feb. 16, 1984 and is now U.S. Pat. No. 4,608,212. Application Ser. No. 580,881 was a continuation in part of my earlier application Ser. No. 709,601, filed July 29, 1976, now abandoned.

This invention relates to synthetic textile fiber deformation and particularly to methods and apparatus for effecting electrostatically induced radially directed disruptive surface deformation of lineal monofilaments adjacent the locus of liquid emission thereof in a gaseous environment and enhanced solidification of the deformed monofilament into a self-supporting state.

Fibers of both natural and synthetic origin are widely employed at the present day in the textile field. Among the more familiar fibers of natural origin are vegetable fibers such as cotton, flax and the like and animal fibers such as wool and other animal hairs. The more recent years have seen an ever increasing usage of fibers of synthetic origin formed from various synthetic resinous materials and, on some occasions, from glass. While such synthetic fibers are possessed of many advantageous characteristics, the generally smooth and uniform surface characteristic of the individual fibers thereof oftentimes results in finished textile products of somewhat different character and texture i.e. "hand", than textile products formed of natural fibers, which are of a more non-uniform surface configuration.

Certain of the widely employed synthetic resinous fibrers such as polyamide and polyester fibers, as well as certain non-resinous fibrous materials such as glass, are formed by the withdrawal of a monofilament from a molten reservoir thereof into a gaseous, as distinguished from a liquid, environment. Conventionally, such operation, which is generally termed "spinning", is effected by the withdrawal of the material in monofilament form through a small orifice in the liquid state, the subsequent setting of the withdrawn monofilament into effectively self-supporting condition, normally expedited by quenching air streams or the like and by the winding of the self-supporting monofilament on a reel or drum, oftentimes after subjecting the withdrawn monofilament to sufficient tension, at least for certain synthetic resinous materials, to effect an elongating deformation thereof.

Fibers so formed are in the nature of essentially straight line or lineal monofilaments of relatively uniform diameter and smooth perimetric contour. Such uniformity of diameter and smooth perimetric contour that are generally characteristic of such synthetic fiber fabrication oftentimes require subsequent treatment or deformation, such as, for example, false twisting in order to modify the filament character and to render such fibers more suitable for textile fabrication.

One of the long sought objectives of this art has been the production of synthetic fibers characterized by a non-uniform surface configuration to permit the attaining of textile products formed therefrom that additionally have some of the desirable properties that were heretofore only characteristic of textile products formed of fibers of natural origin. Over the years, many methods and techniques for effecting different types of synthetic fiber deformation have been suggested by the art. However, whether because of only marginal utility or economic impracticality of such suggestions, the selective modification of the surface contour of synthetic fibers in such manner as to permit the attaining of textile products therefrom having some of the desirable characteristics of natural fiber products, has been a long sought and as yet commercially unattained objective of this art.

SUMMARY OF THE INVENTION

This invention may be briefly described, in its broad aspects, as an improved method and apparatus for effecting electrostatically induced and radially directed disruptive deformation of the surface of lineal monofilaments adjacent the locus of liquid emission from a molten reservoir thereof in a gaseous environment and enhanced temperature modification to accelerate solidification of the so deformed monofilaments into a self-supporting state. In its narrower aspects, the invention includes the subjection of a moving filament of liquid material to selectively constituted electrostatic field forces to destructively disrupt the perimetric defining surface thereof to prooduce generally radially directed hair-like appendages extending therefrom and to concomitantly reduce the temperature of the surface disrupted portion of the filament to effect the solidification or setting of such disrupted surfaces before the normal surface tension forces of the material can effect a return of such surfaces to a smooth and lineal configuration. In another aspect, the invention includes the incorporation of a needle-like electrode element within the flowing filamentous material adjacent the locus of emission thereof in association with adjacent particularly configured electrode elements adapted to effect the desired selective thermal modification, fiber deformation and necessary rapid setting of the fiber surfaces in deformed condition.

The primary object of this invention is the provision of methods and apparatus for effecting electrostatically induced radially directed surface deformation of lineal textile monofilaments in a gaseous environment to produce discrete hair-like appendages extending therefrom.

A further object of this invention is the provision of methods and apparatus for effecting the electrostatically induced thermal preconditioning and radially directed disruptive surface deformation of liquid monofilamentous material in a gaseous environment to produce hair-like appendages extending therefrom and a concomitant electrostatically induced accelerated solidification of the disruptively deformed monofilamentous material into self-supporting condition.

Other objectives and advantages of the invention will become apparent from the following portions of this specification and from the appended drawings which illustrate, in accord with the requirements of the patent statutes, presently preferred apparatus elements incorporating the principles of this invention.

BRIEF DESCRIPTION OF THE DRAWINGS

FIG. 1 is a schematic representation, partly in section, of one suggested type of electrode configuration and its general positional relation to monofilament being emitted in liquid condition from a molten reservoir thereof;

FIG. 2 is a vertical section taken on the line 2—2 of FIG. 1;

FIG. 3 is a schematic plan view of an alternate secondary electrode configuration;

FIG. 4 is a schematic vertical section of a further alternative electrode configuration;

FIG. 5 is a schematic vertical section of an electrode cored spinnerette assembly;

FIG. 6 is a schematic plan view of a further electrode configuration.

DETAILED DESCRIPTION OF THE PREFERRED EMBODIMENT

Referring to the drawings and initially to FIGS. 1 and 5 there is provided a reservoir 10 adapted to contain a supply of molten material capable of being emitted through a small aperture in a spinnerette 12 into a gaseous environment as a liquid monofilament 14. Materials of the type contemplated include synthetic resinous materials such as polyamides and polyesters conventionally employed as textile fibers and non-resinous materials such as glass.

As shown in more detail in FIG. 5, the aperture 30 in the spinnerette 12 has mounted therein a grounded elongate needle like primary electrode element 32. The primary needle like electrode element 32 is a length to extend over a sufficient length of emitted filament 34 while in liquid condition to permit the thermal modification and disruptive surface deformation thereof by the applied electrostatic field. Optimally the electrode element 32 should be of a length to permit effective thermal modification and desired hair-like appendage producing disruptive surface deformation of the liquid monofilamentous material at or near its dependent end and concomitant electrostatic quenching or cooling thereof to effect a hastened setting or solidification of the filament surfaces in deformed condition at or slightly downstream of such needle end. As will become apparent, the dependent end of the needle element appears to serve as one terminus of an electrostatic field and its location, in spaced relation to the spinnerette 12, is generally definitive of the locus of filament deformation. In addition to serving as the terminus of an electrostatic field, such needle 32 serves to fix or define the flow path of the emitted molten filamentous material 14 and to thereby stabilize filament positioning as the liquid filamentous material moves to and through the locus of deformation.

As schematically depicted in FIG. 1, disposed in spaced relation with the emitted liquid monofilament 14 and located in spaced proximity with the lower end of the needle electrode 32, is a high voltage electrode element 16. As shown in FIG. 1 the electrode 16 may suitably be of circular configuration and disposed in encircling relation with the moving liquid filamentous material and adapted to be connected to a remote high voltage, direct current source of electrical potential. Application of such high d.c. potential to the electrode element 16 will create an electrostatic field extending from the end of needle 32, through the surrounding liquid filamentous material and to the encircling electrode. The magnitude of the potential applied to the electrode element 16 is then increased with an attendant increase in the strength of the electrostatic field until the surface of the moving liquid monofilament is disruptively deformed to a desired degree. Depending upon the particular operating parameters for the particular filamentous material involved, such disruptive electrostatic field is also capable of concomitantly functioning to electrostatically thermally modify the filament surface prior to and after the disruptive deformation thereof and thus may also serve to thereby precondition the surface to be deformed and to rapidly set or solidify the so deformed surface thereof before the normal tension forces of the material can effect a return of such surfaces to a smooth and lineal configuration. In some instances, however, auxiliary electrode element means, as indicated by the dotted lines 18, may be employed above and/or below the secondary high voltage electrode element 16 to create an auxiliary electrostatic field or fields of non-disruptive character to precondition the moving liquid filament and/or to co-operatively enhance the electrostatic cooling effects of the disruptive electrostatic field. As shown, such auxiliary electrodes 18 may precede the locus of disruptive deformation so as to thermally precondition the filament for deformation or may be disposed downstream of the locus of the disruptive deformation and to thereby so reduce the temperature of the surface disrupted portions of the filament as to rapidly initiate the solidification or setting of such disrupted surfaces.

While not fully understood, available information appears to indicate that the radially directed surface deformation of the moving liquid filamentous material at the locus of deformation is induced mainly by dielectricphoresis phenomena and possibly to a lesser extent by flow of current. It likewise appears that the surface tension of the moving liquid filament, as determined by temperature and the chemical nature of the filament, the degree or lack of conductivity of the moving liquid filament, the strength of the electric field, as determined by the nature, shape and spacing of the electrode elements and the magnitude of the potentials employed and the ambient temperatures at the filament surface, closely prior to, at, and closely downstream of the locus of deformation are variables attendant with varying degrees of criticality which determine the type and extent of the degree of deformation effected. The presently preferred type of radially directed surface deformation is the production of outwardly radially directed hair-like appendages.

Other types of surface deformation include surface roughening through generation of outwardly radially directed conical nodes, which are believed to represent an initial deformation state that is terminated before the production of the aforesaid hair-like appendages.

As will now be apparent to those skilled in this art, the electrostatic cooling or quenching of the liquid filament to expedite the solidification thereof can be of marked utility and advantage, in and of itself, and apart from disruptive or other filament deformation, in textile fiber spinning operations. Such electrostatic cooling phenomena, which was more recently re-recognized in U.S. Pat. No. 3,224,497 and was described in an article in Electronic Design 20, Sept. 30, 1971, p. 22, can be employed to advantage for filament quenching where disruptive deformation of the filament surface is not employed, and will permit the elimination of some of the disadvantages associated with the currently employed moving air streams and quenching chambers. Such electrostatic cooling in association with the primary electrode needle 32 also will permit the fabrication of filaments of cross sectional configuration other than round, again with or without deformation operation, through expedited setting or solidification of the liquid threads emitted through selectively shaped apertures over selectively shaped needle elements.

In this latter area the functions of the primary electrode element 32 in fixing the flow path of the molten filament is of particular importance since it effectively prevents displacement of the filament as a whole in the transverse direction and permits effective and uniform temperature reductions of the moving filament.

The circular or ring type high voltage electrode element means as illustrated in FIGS. 1 and 2 presents an arcuate or rounded surface to the moving filament and additionally provides a generally uniform electrostatic field with the end of the needle 32 as the other terminus thereof. If such ring 16 conductively extends through 360° it will serve to produce an essentially random type of disruptive deformation of the surface of the monofilamentous material. Alternatively such ring 16 could be circumferentially segmented to define a plurality of discrete high voltage electrode elements each presenting a rounded or arcuate surface to the moving filament. In contradistinction thereto, a plurality of needle like electrode elements disposed in facing relation to the end of the primary electrode needle 32 could be employed to provide a non-uniform electrostatic field. By way of illustrative example as shown in FIG. 3, one or more of such needle like electrode elements 20 may be positionally located by mounting the same on an encircling mounting ring or the like so as to be radially disposed in operative spaced relation with the end of the primary electrode 32 and with the axially located liquid filamentous material flowing therepast.

Here again, the ends of the needle like electrode elements 20 can be of rounded configuration rather than of pointed configuration, as generally shown in FIGS. 1 and 2. If desired, the ends of the electrodes 20 may be provided with spherical ends to present an arcuate or rounded surface in spaced facing relation to the moving liquid filamentous material flowing past the end of the primary elecrode element 32.

FIG. 4 illustrates still another electrode configuration. In this embodiment, a circular electrode element 22 is provided with an interiorly directed conical shoulder 24 terminally in a point like corona emittable ring 26 disposed in spaced encircling relating with the liquid monofilamentous material.

FIG. 6 is schematically illustrative of a pair of diametrically opposed rounded surface electrode elements 40 and 42. In this embodiment, each electrode is adapted to be connected to a source of high alternating potential of the same frequency but preferably at 180° out of phase. Such will create a high intensity oscillating or reversing electrostatic force field which, when adjusted to proper magnitude, will effect a selective deformation of the liquid filamentous material.

As will now be apparent to those skilled in this art, the drawings herein schematically depict an electrode system for effecting radially directed surface deformation of a single filament. However the principles herein disclosed are equally applicable to pluralities of spinnerettes as are conventionally employed in the commercial spinning of both textile and glass fibers. In such environment a single high voltage electrode, as for example a needle like high voltage electrode element 20 having a spherical tip, may be located intermediate a plurality of primary electrodes 32, as for example at the intersection of the diagonals of four squarely spaced spinnerettes, and to thereby simultaneously serve four primary electrodes 32.

Having thus described my invention, I claim:

1. An apparatus for producing monofilamentous fibers wherein a liquid monofilament having a smooth surface is emitted at high temperature from an aperture in a molten reservoir thereof into a gaseous environment having an ambient temperature less than the temperature of said emitted liquid monofilament, a rigid needle-like primary electrode element dependent from said aperture in said reservoir adapted to be surrounded by downwardly flowing liquid filamentous material and defining one terminous of a selectively directed electrostatic field, a second electrode defining a second terminus of said selectively directed electrostatic field disposed in facing and transverse spaced relation with the longitudinal extent of said primary electrode element, and means for applying a high voltage to said second electrode element to create said selectively directed unidirectional electrostatic field disposed transverse to and traversing said downwardly flowing smooth surfaced liquid filamentous material surrounding said primary electrode element to selectively modify the physical character of the smooth surface thereof.

2. The apparatus as set forth in claim 1 wherein the exposure of the portion of the downwardly flowing liquid filamentous material surrounding said primary electrode to said electrostatic field modifies the character of the smooth surface thereof by effecting a localized surface disruptive and outwardly radially directed disruptive deformation of such surface to produce radially extending hair like appendages thereon.

3. The apparatus as set forth in claim 2 wherein exposure of the portion of the downwardly flowing liquid filamentous material surrounding said primary electrode to said transverse electrostatic field concurrently effects a reduction in the surface temperature of said deformed portions of the surface of said monofilament to accelerate the solidification thereof in deformed condition.

4. The apparatus as set forth in claim 2 wherein said second electrode includes an arcuate surface disposed in facing spaced relation with said primary electrode element.

5. The apparatus as set forth in claim 1 wherein exposure of the portion of said high temperature liquid filamentous material surrounding said primary electrode element to said electrostatic field effects a reduction in the surface temperature thereof.

* * * * *